US010865009B1

(12) United States Patent
Al-Housseiny

(10) Patent No.: US 10,865,009 B1
(45) Date of Patent: Dec. 15, 2020

(54) BLANK USED FOR MAKING A CONTAINER WITH INSERTABLE TABS

(71) Applicant: Talal T. Al-Housseiny, Princeton, NJ (US)

(72) Inventor: Talal T. Al-Housseiny, Princeton, NJ (US)

( * ) Notice: Subject to any disclaimer, the term of this patent is extended or adjusted under 35 U.S.C. 154(b) by 0 days.

(21) Appl. No.: 16/532,854

(22) Filed: Aug. 6, 2019

(51) Int. Cl.
*B65D 5/36* (2006.01)

(52) U.S. Cl.
CPC ..... *B65D 5/3614* (2013.01); *B65D 5/3635* (2013.01)

(58) Field of Classification Search
CPC ..... B65D 5/3621; B65D 5/02; B65D 5/4266; B65D 2571/00487; B65D 71/0022; B65D 2571/00524; B65D 2571/00839
USPC ..... 229/117.05, 117.01, 117.09, 120.18, 229/120.21, 120.14, 120.15, 165; 206/180, 190, 175, 184, 186; 493/51, 59
See application file for complete search history.

(56) References Cited

U.S. PATENT DOCUMENTS

| | | | |
|---|---|---|---|
| 728,749 | A | 5/1903 | McCord |
| 1,158,130 | A | 10/1915 | Hawkins |
| 1,852,527 | A | 4/1932 | King |
| 2,713,965 | A | 7/1955 | Acker |
| 2,741,415 | A | 4/1956 | Meitzen |
| 2,795,352 | A | 6/1957 | Ringler |
| 3,016,181 | A | 1/1962 | Desmond |
| 3,119,547 | A | 1/1964 | Nute |
| 3,194,480 | A | 7/1965 | Maindron |
| 3,199,762 | A | 8/1965 | Coons |
| 3,294,221 | A | 12/1966 | Notko et al. |
| 3,539,090 | A | 11/1970 | Blasdell |
| 3,549,081 | A | 12/1970 | Nelson |
| 3,642,192 | A | 2/1972 | Wilcox, Jr. et al. |
| 3,850,362 | A | 11/1974 | Stollberg et al. |
| 3,917,060 | A | 11/1975 | Wood |
| 3,951,332 | A | 4/1976 | Torbeck |
| 3,960,313 | A | 6/1976 | Sax |

(Continued)

FOREIGN PATENT DOCUMENTS

| | | | |
|---|---|---|---|
| GB | 1315598 | A | 5/1973 |

OTHER PUBLICATIONS

International Search Report and Written Opinion dated Jan. 19, 2018; International Application No. PCT/US2017/060565; International Filing Date: Nov. 8, 2017; 6 pages.

*Primary Examiner* — Christopher R Demeree
(74) *Attorney, Agent, or Firm* — Meagher Emanuel Laks Goldberg & Liao, LLP

(57) ABSTRACT

A blank used for making a container with insertable tabs is disclosed. The blank comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab. The tab extends towards the secondary flap. At least a portion of the tab lies within an aperture positioned between the primary flap and the secondary flap. The tab is configured to be inserted in the opening when the container is in a box configuration. Embodiments foster a container with insertable tabs that rapidly, easily, and conveniently transitions to a box configuration. Moreover, the container provides convenience and efficiency without compromising cost effectiveness and structural integrity.

9 Claims, 16 Drawing Sheets

(56) References Cited

U.S. PATENT DOCUMENTS

| | | | | |
|---|---|---|---|---|
| 4,017,019 | A | 4/1977 | Booth | |
| 4,131,227 | A | 12/1978 | Patton et al. | |
| 4,219,147 | A | 8/1980 | Kohler | |
| 4,238,068 | A | 12/1980 | Ellerbe et al. | |
| 4,279,379 | A | 7/1981 | Lohrbach et al. | |
| 4,415,117 | A | 11/1983 | Pollard | |
| 4,830,270 | A | 5/1989 | Holmes | |
| 4,981,258 | A | 1/1991 | Blanke | |
| 5,065,935 | A | 11/1991 | Mancel | |
| 5,096,114 | A | 3/1992 | Higginbotham | |
| 5,125,567 | A | 6/1992 | McClure | |
| 5,184,772 | A | 2/1993 | McGrath | |
| 5,285,957 | A | 2/1994 | Halsell | |
| 5,664,726 | A | 9/1997 | Opper | |
| 6,109,513 | A | 8/2000 | Dugan | |
| 6,158,652 | A | 12/2000 | Ruiz et al. | |
| 8,590,772 | B2 * | 11/2013 | Delause | B65D 5/001 229/125.01 |
| 8,622,282 | B2 | 1/2014 | Brundage | |
| 8,733,625 | B2 | 5/2014 | Costanzo, Jr. | |
| 8,777,094 | B2 | 7/2014 | Strong et al. | |
| 8,944,312 | B2 | 2/2015 | Won et al. | |
| 8,960,527 | B2 | 2/2015 | Hui | |
| 9,073,664 | B2 * | 7/2015 | Justice | B65D 5/6632 |
| 9,296,509 | B2 | 3/2016 | McLeod | |
| 9,725,223 | B2 * | 8/2017 | Chang | B65D 81/022 |
| 9,908,304 | B2 | 3/2018 | Aganovic et al. | |
| 10,160,567 | B2 | 12/2018 | Al-Housseiny | |
| 2005/0006446 | A1 | 1/2005 | Stafford, Jr. | |
| 2007/0218756 | A1 | 9/2007 | Takemoto et al. | |
| 2013/0026215 | A1 | 1/2013 | Lenhard et al. | |
| 2016/0039560 | A1 | 2/2016 | Sharp | |

* cited by examiner

100a

100b

100c

100d

200a

200b

200c

200d

BLANK USED FOR MAKING A CONTAINER WITH INSERTABLE TABS

FIELD OF THE INVENTION

Embodiments are in the field of containers. More particularly, embodiments disclosed herein relate to blanks used for making containers which, inter alia, foster a container with insertable tabs that rapidly, easily, and conveniently transitions to a box configuration. The container provides convenience and efficiency without compromising cost effectiveness and structural integrity.

BACKGROUND OF THE INVENTION

There are several challenges that are associated with common containers used in packaging, shipping, moving, etc. Significant time is required to setup/make a typical container, and to seal/close a typical container. In addition, it is inconvenient to tape flaps while maintaining them folded in place.

To address the previous challenges, a number of alternative containers have been proposed. These alternative containers (e.g., tuck top, interlocking flaps, folding inserts, extended flaps with seal tape, etc.) use significantly more material than typical containers. As a result, cost effectiveness may be compromised. In addition, these alternative containers may not provide a substitute for the use of tape. For example, in mail shipping applications, containers are still required to be taped to protect the content.

Thus, it is desirable to provide a blank for making a container that is able to overcome the above disadvantages.

Advantages of the present invention will become more fully apparent from the detailed description of the invention hereinbelow.

SUMMARY OF THE INVENTION

Embodiments are directed to a blank used for making a container. The blank comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab. The tab extends towards the secondary flap. At least a portion of the tab lies within an aperture positioned between the primary flap and the secondary flap. The secondary panel is configured to fold towards the primary panel. The secondary flap is configured to fold towards the secondary panel. The primary flap is configured to fold towards the primary panel. The tab is configured to be inserted in the opening when the container is in a box configuration.

Embodiments are also directed to a container. The container comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab. The tab extends towards the secondary flap when the container is in a flat configuration. At least a portion of the tab lies within an aperture positioned between the primary flap and the secondary flap when the container is in the flat configuration. The secondary panel is configured to fold towards the primary panel. The secondary flap is configured to fold towards the secondary panel. The primary flap is configured to fold towards the primary panel. The tab is configured to be inserted in the opening when the container is in a box configuration.

Additional embodiments and additional features of embodiments for the blanks used for making containers are described below and are hereby incorporated into this section.

BRIEF DESCRIPTION OF THE DRAWINGS

The detailed description will refer to the following drawings, wherein like reference numerals refer to like elements, and wherein.

DETAILED DESCRIPTION OF THE INVENTION

Figure 1A:
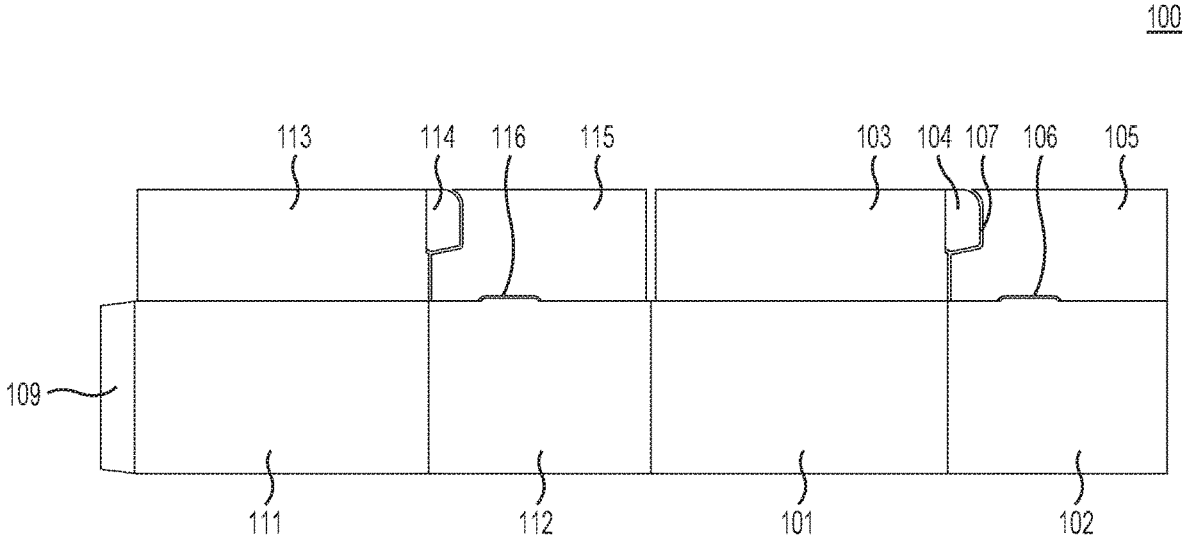
FIG. 1A is a diagram illustrating a plan view of an embodiment of a blank used for making a container. The blank comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab.

It is to be understood that the figures and descriptions of the present invention may have been simplified to illustrate elements that are relevant for a clear understanding of the present invention, while eliminating, for purposes of clarity, other elements found in a typical container or typical method of using a container. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

For purposes of this disclosure, the expression "A is hingedly coupled to B" refers to an element A being movably coupled to an element B via a hinge. A hinge may comprise a perforation, a crease, a score, a bend, a section with less thickness than surrounding material, a section with less density than surrounding material, and a combination thereof.

For purposes of this disclosure, the expression "A is configured to fold towards B" refers to at least a portion of element A being configured to fold towards at least a portion of element B via a hinge.

Embodiments are directed to a blank used for making a container. The blank comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab. The tab extends towards the secondary flap. At least a portion of the tab lies within an aperture positioned between the primary flap and the secondary flap. The secondary panel is configured to fold towards the primary panel. The secondary flap is configured to fold towards the secondary panel. The primary flap is configured to fold towards the primary panel. The tab is configured to be inserted in the opening when the container is in a box configuration.

Embodiments are also directed to a container. The container comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab. The tab extends towards the secondary flap when the container is in a flat configuration. At least a portion of the tab lies within an aperture positioned between the primary flap and the secondary flap when the container is in the flat configuration. The secondary panel is configured to fold towards the primary panel. The secondary flap is configured to fold towards the secondary panel. The primary flap is configured to fold towards the primary panel. The tab is configured to be inserted in the opening when the container is in a box configuration.

The container may be used for packaging (e.g., consumer products, electronics, cosmetics, pharmaceuticals, food, etc.), for shipping (e.g., mail, domestic shipping, overseas shipping, transfers, deliveries, etc.), for moving (e.g., residential, commercial, etc.), and for storage (e.g., products, belongings, tools, material, etc.), or other suitable uses. The uses of the container are abundant and the wide spectrum of users may include manufacturers, packaging companies, distributors (e.g., fulfillment centers, warehouses, storage facilities, etc.), shipping companies, and the end-consumers (e.g., to store belongings, to move contents of an end-consumer's residence, to ship items via a mail shipping or delivery company, etc.).

The composition of the blank may vary. Portions or all of the blank may comprise a suitable flexible material that allows for folding, collapsing, and moving such as cardboard, paperboard, paper, corrugated carton, plastic, corrugated plastic, polymers, metal, or combinations thereof. In addition, the blank may comprise a plurality of different suitable materials. The material of any portion of the blank may be chosen for reusability of the container, or, alternatively, the material may be chosen based on a disposable (i.e., a one-time or limited use) variation.

The size, dimensions, thickness, shape, and weight of the blank or portions of the blank may vary. The primary panel, the secondary panel, the secondary flap, the primary flap, and the tab may be configured based on the desired overall features of the container and/or contents to be contained within the container. Hence, the size, dimensions, thickness, shape and weight of the primary panel, the secondary panel, the secondary flap, the primary flap, and the tab may vary. Moreover, the position, the length and the orientation of the various hinges may be configured based on the desired overall features of the container.

The manufacturing of the blank may vary. Desired objectives for the manufacturing processes may include reducing material costs, reducing manufacturing costs, reducing material waste, reducing manufacturing complexity, reducing shipping costs, or a combination thereof. The blank may be a single sheet of material or may be assembled by coupling (e.g., connecting or attaching) various portions of a plurality of independent sheets of material. Furthermore, portions or all of the blank may comprise more than one layer of material. For example, multiple layers of material may be attached or glued to each other.

The manufacturing of the container may vary. Desired objectives for the manufacturing processes may include reducing material costs, reducing manufacturing costs, reducing material waste, reducing manufacturing complexity, reducing shipping costs, or a combination thereof. The container may be made from a single sheet of material or may be assembled by coupling (e.g., connecting or attaching) various portions of a plurality of independent sheets of material.

FIG. 1A is a diagram illustrating a plan view of an embodiment of a blank 100 used for making a container. The blank 100 comprises a primary panel 101, a secondary panel 102, and an opening 106. The secondary panel 102 is hingedly coupled to the primary panel 101. The secondary panel 102 is hingedly coupled to a secondary flap 105. The primary panel 101 is hingedly coupled to a primary flap 103. The primary flap 103 is hingedly coupled to a tab 104. The blank 100 also comprises a glue flap 109.

Figure 1B:
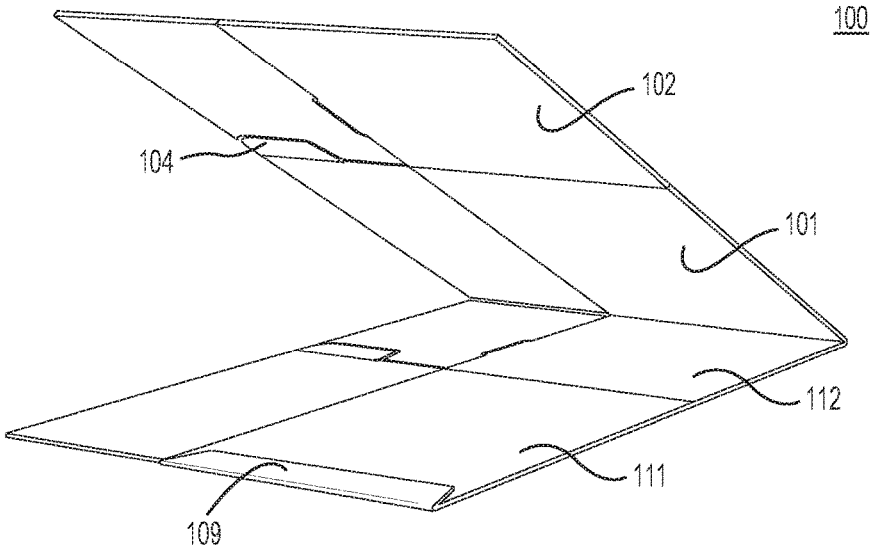
FIG. 1B is a diagram illustrating a perspective view of the blank shown in FIG. 1A, wherein the blank is folded.

FIG. 1B is a diagram illustrating a perspective view of the blank 100 shown in FIG. 1A, wherein the blank 100 is folded.

Figure 1C:
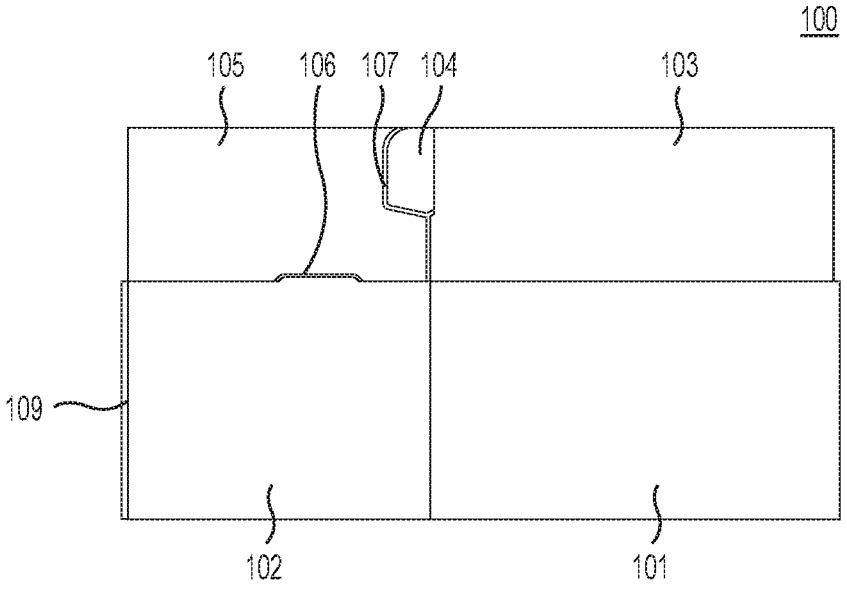
FIG. 1C is a diagram illustrating a plan view of a flat configuration of the container made from the blank shown in FIG. 1A.

FIG. 1C is a diagram illustrating a plan view of a flat configuration of the container made from the blank 100 shown in FIG. 1A.

Figure 1D:
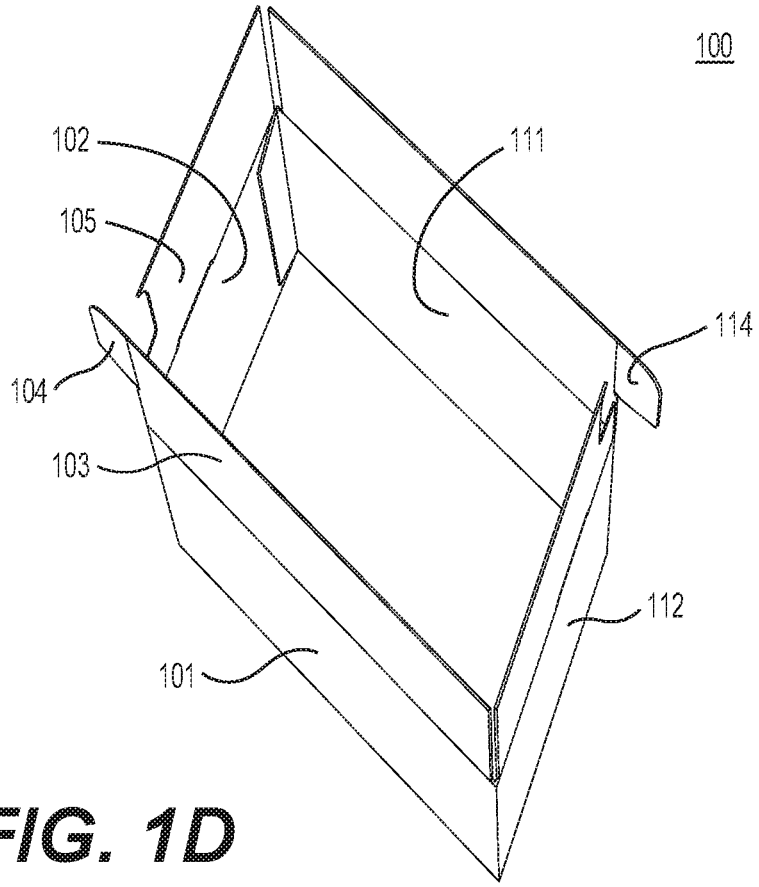
FIG. 1D is a diagram illustrating a perspective view of the container made from the blank shown in FIG. 1A, wherein the container is moved from the flat configuration to a box configuration.

FIG. 1D is a diagram illustrating a perspective view of the container made from the blank 100 shown in FIG. 1A, wherein the container is moved from the flat configuration to a box configuration.

Figure 1E:
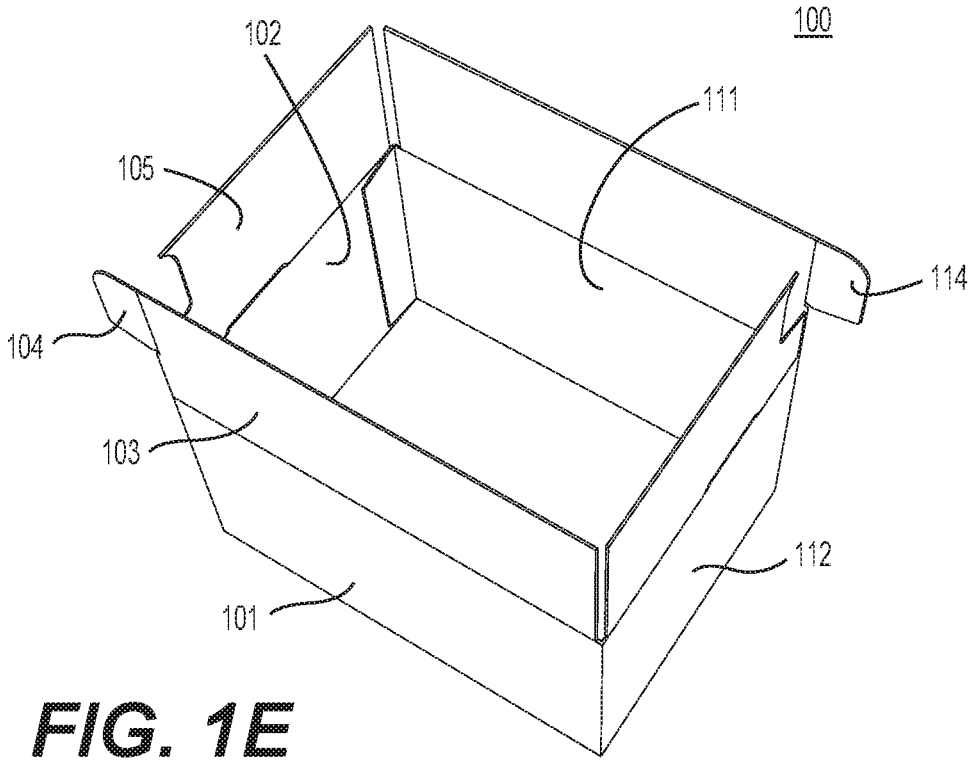
FIG. 1E is a diagram illustrating a perspective view of the box configuration of the container made from the blank shown in FIG. 1A.

FIG. 1E is a diagram illustrating a perspective view of the box configuration of the container made from the blank 100 shown in FIG. 1A.

Figure 1F:
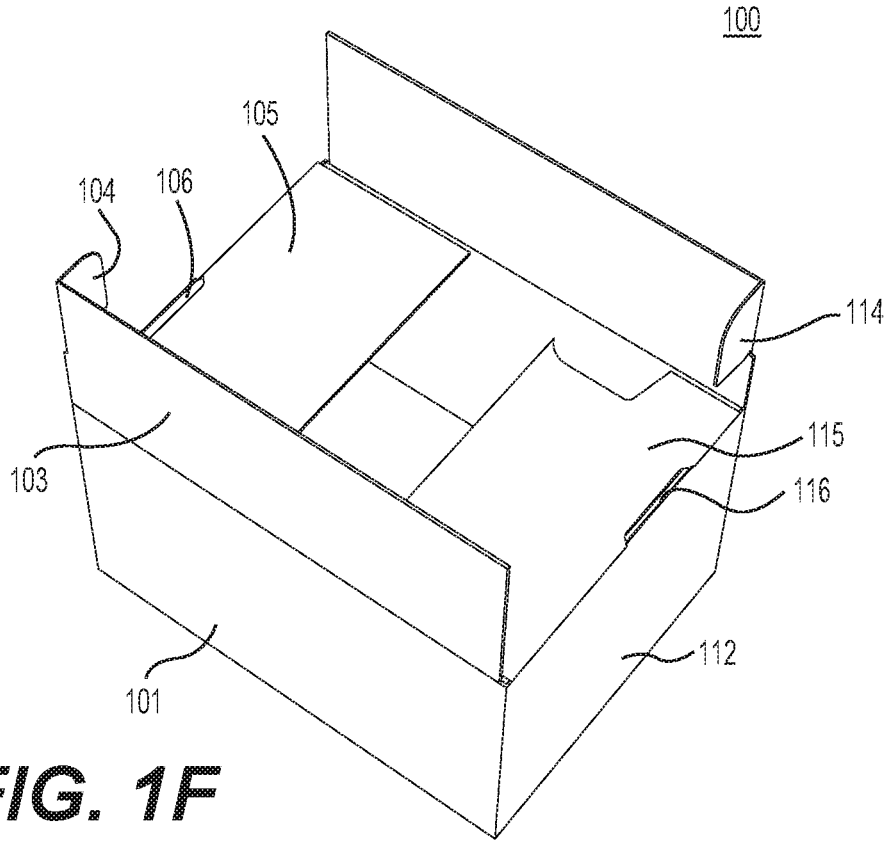
FIGS. 1F-1H is a sequence illustrating perspective views of the box configuration of the container made from the blank shown in FIG. 1A, wherein the secondary flap is folded, wherein the primary flap is folded, and wherein the tab is inserted in the opening.
Figure 1G:
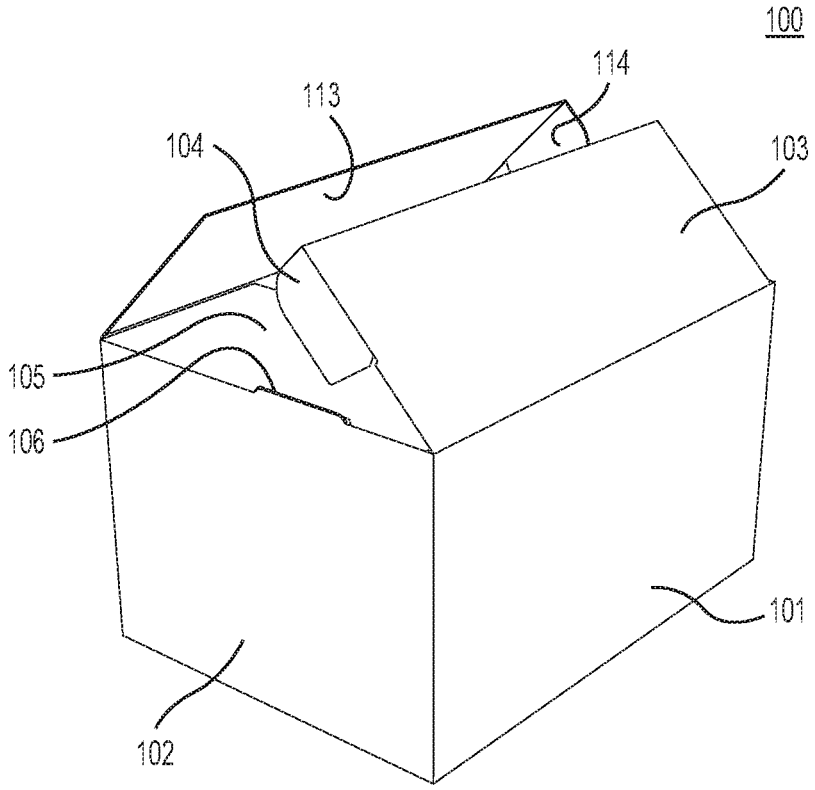
Figure 1H:
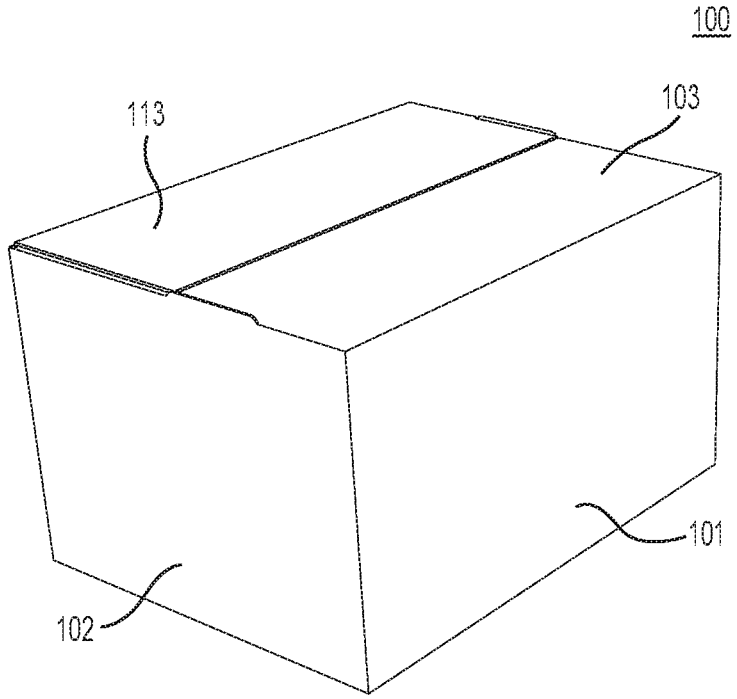

FIGS. 1F-1H is a sequence illustrating perspective views of the box configuration of the container made from the blank 100 shown in FIG. 1A, wherein the secondary flap 105 is folded, wherein the primary flap 103 is folded, and wherein the tab 104 is inserted in the opening 106.

Figure 2A:
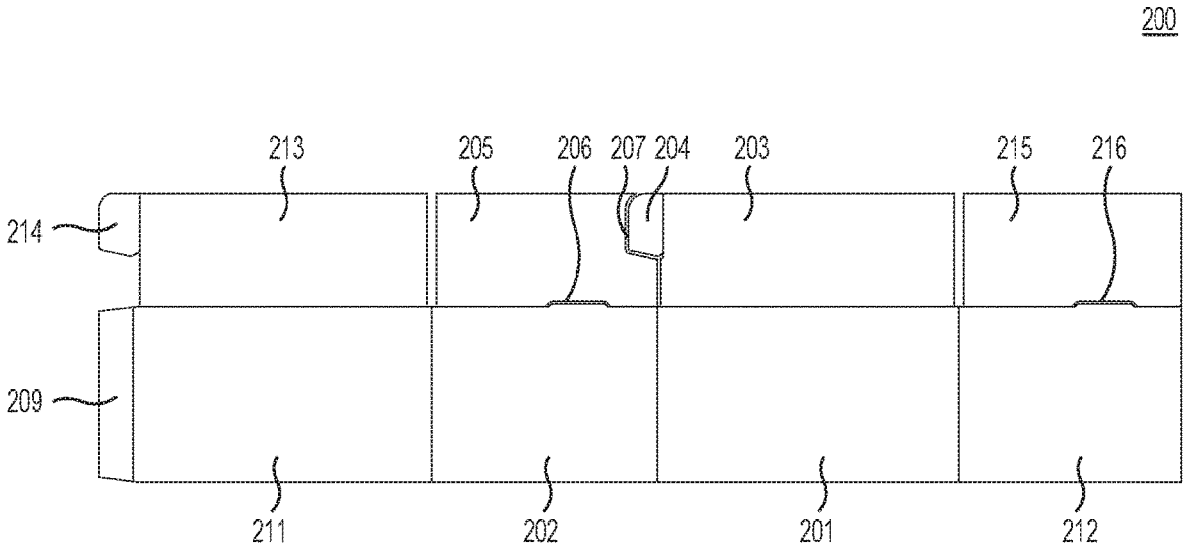
FIG. 2A is a diagram illustrating a plan view of an embodiment of a blank used for making a container. The blank comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab.

FIG. 2A is a diagram illustrating a plan view of an embodiment of a blank 200 used for making a container. The blank 200 comprises a primary panel 201, a secondary panel 202, and an opening 206. The secondary panel 202 is hingedly coupled to the primary panel 201. The secondary panel 202 is hingedly coupled to a secondary flap 205. The primary panel 201 is hingedly coupled to a primary flap 203. The primary flap 203 is hingedly coupled to a tab 204. The blank 200 also comprises a glue flap 209.

Figure 2B:
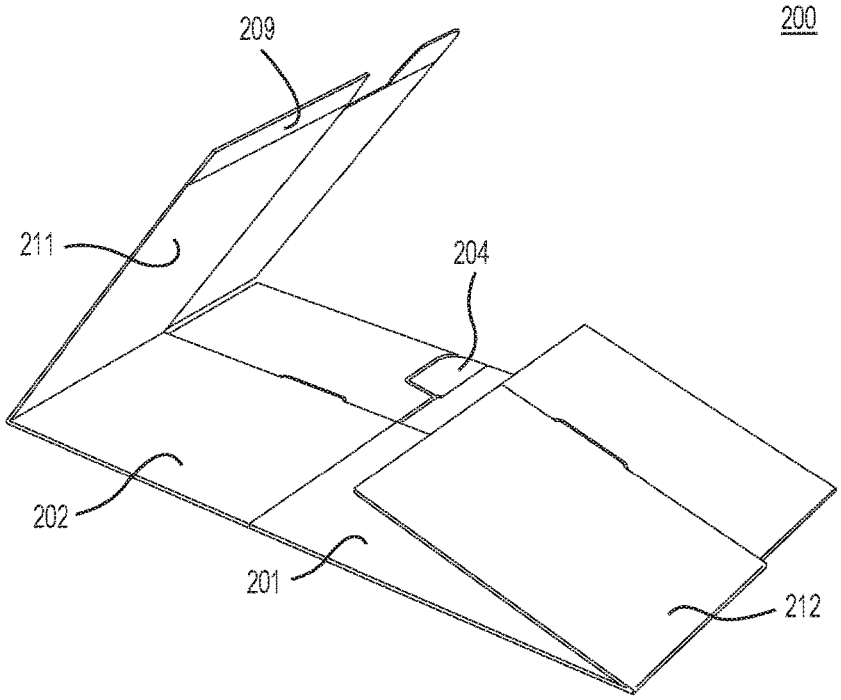
FIG. 2B is a diagram illustrating a perspective view of the blank shown in FIG. 2A, wherein the blank is folded.

FIG. 2B is a diagram illustrating a perspective view of the blank 200 shown in FIG. 2A, wherein the blank 200 is folded.

Figure 2C:
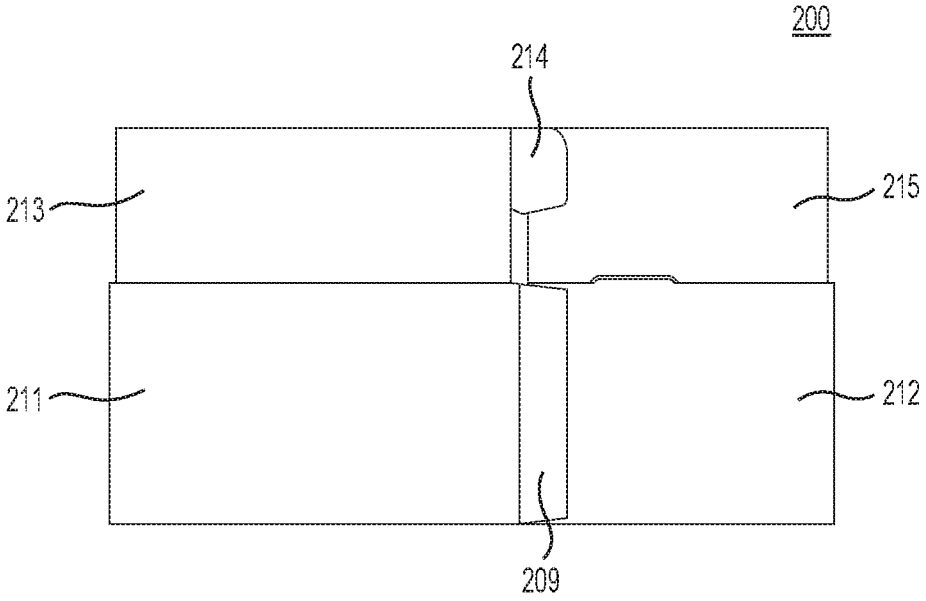
FIG. 2C is a diagram illustrating a plan view of a flat configuration of the container made from the blank shown in FIG. 2A.

FIG. 2C is a diagram illustrating a plan view of a flat configuration of the container made from the blank 200 shown in FIG. 2A.

Figure 2D:
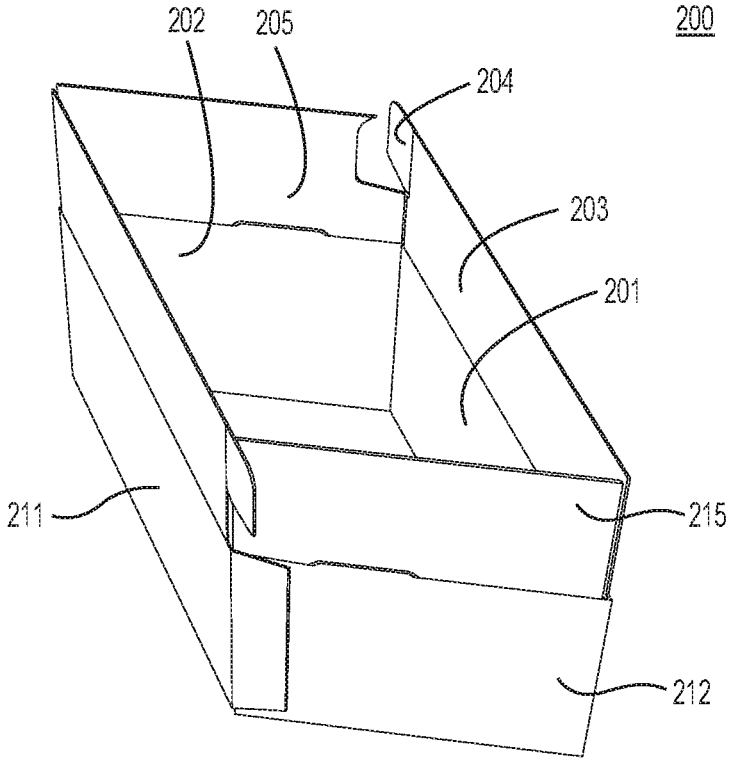
FIG. 2D is a diagram illustrating a perspective view of the container made from the blank shown in FIG. 2A, wherein the container is moved from the flat configuration to a box configuration.

FIG. 2D is a diagram illustrating a perspective view of the container made from the blank 200 shown in FIG. 2A, wherein the container is moved from the flat configuration to a box configuration.

Figure 2E:
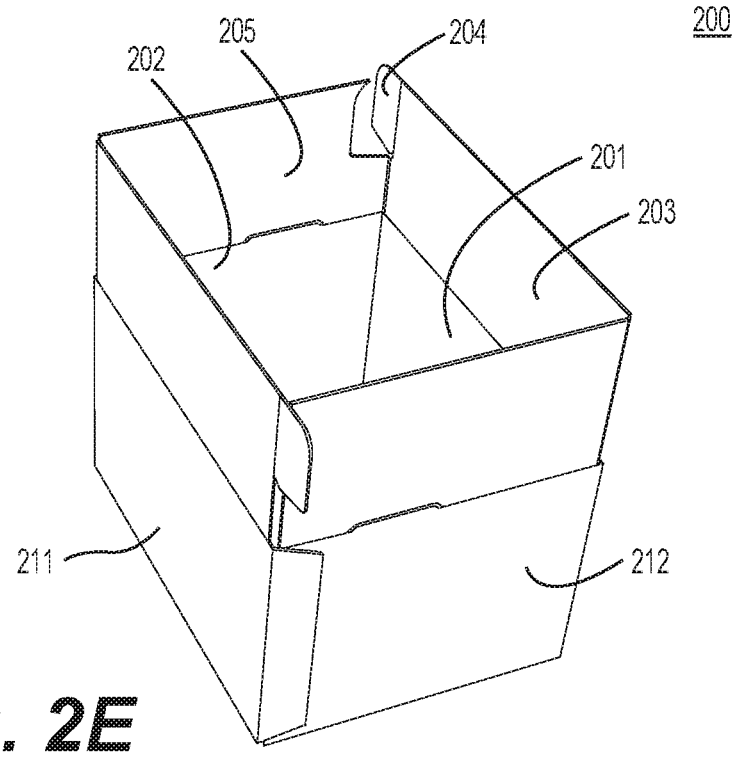
FIG. 2E is a diagram illustrating a perspective view of the box configuration of the container made from the blank shown in FIG. 2A.

FIG. 2E is a diagram illustrating a perspective view of the box configuration of the container made from the blank 200 shown in FIG. 2A.

Figure 2F:
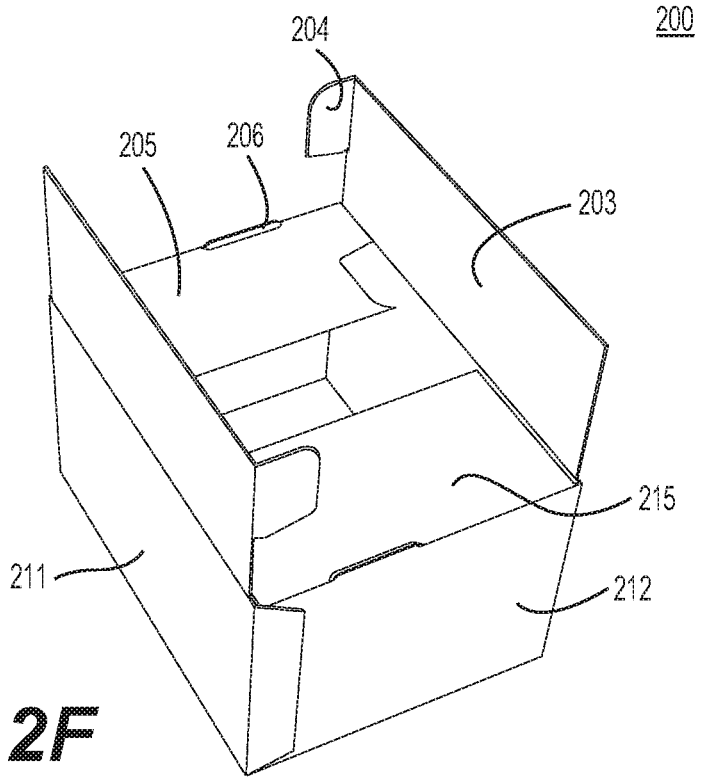
FIGS. 2F-2H is a sequence illustrating perspective views of the box configuration of the container made from the blank shown in FIG. 2A, wherein the secondary flap is folded, wherein the primary flap is folded, and wherein the tab is inserted in the opening.
Figure 2G:
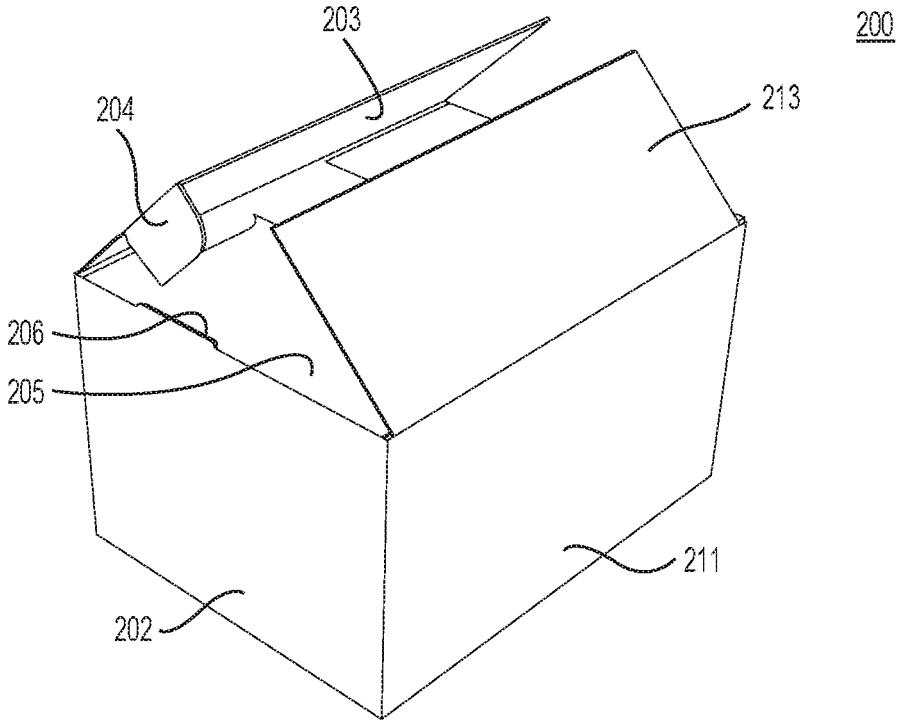
Figure 2H:
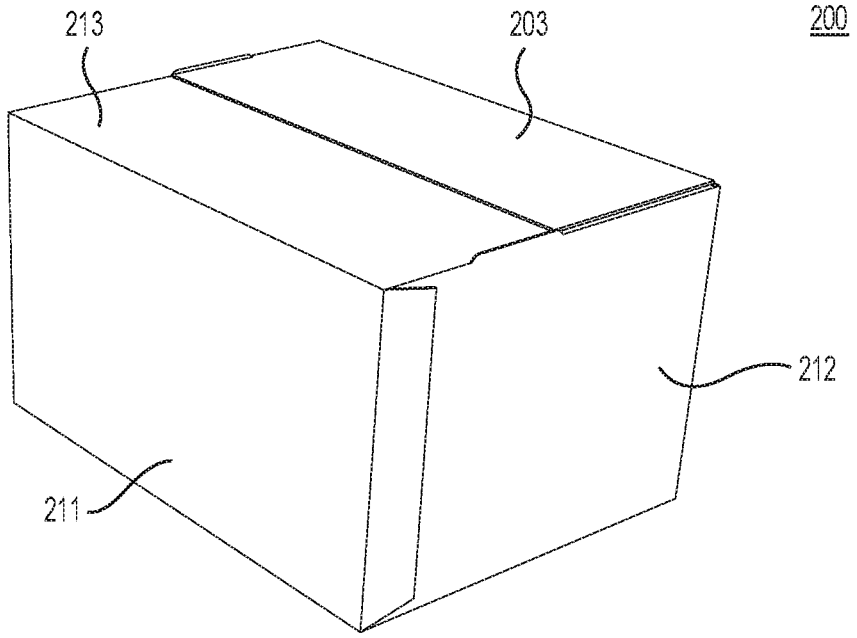

FIGS. 2F-2H is a sequence illustrating perspective views of the box configuration of the container made from the blank 200 shown in FIG. 2A, wherein the secondary flap 205 is folded, wherein the primary flap 203 is folded, and wherein the tab 204 is inserted in the opening 206.

Figure 3A:
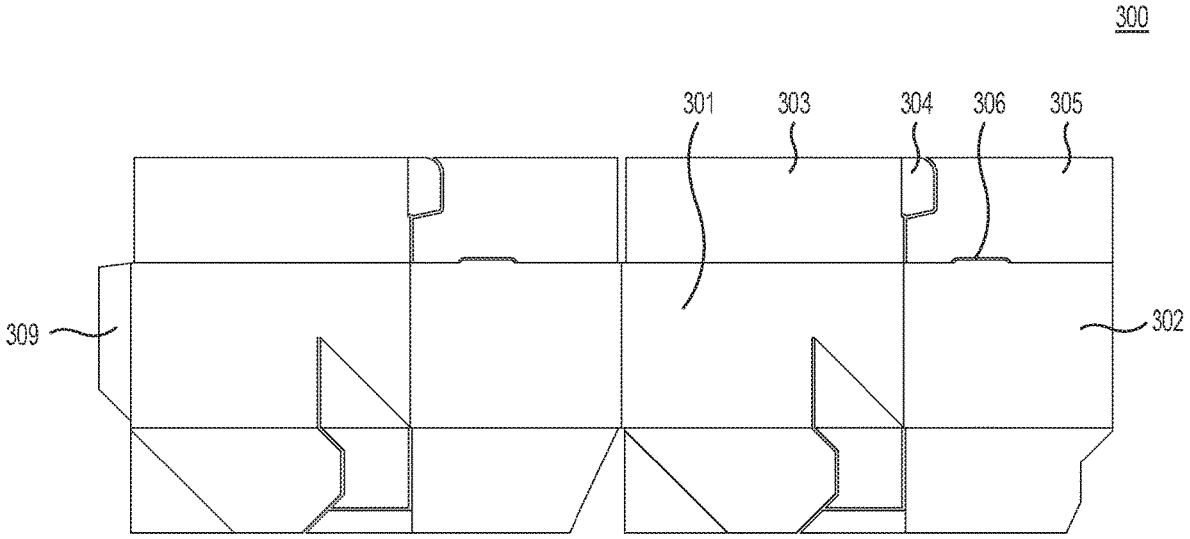
FIG. 3A is a diagram illustrating a plan view of an embodiment of a blank used for making a container. The blank comprises a primary panel, a secondary panel, a primary flap, a tab, a secondary flap, and an opening.

FIG. 3A is a diagram illustrating a plan view of an embodiment of a blank 300 used for making a container. The blank 300 comprises a primary panel 301, a secondary panel 302, a primary flap 303, a tab 304, a secondary flap 305, an opening 306, and a glue flap 309.

Figure 3B:
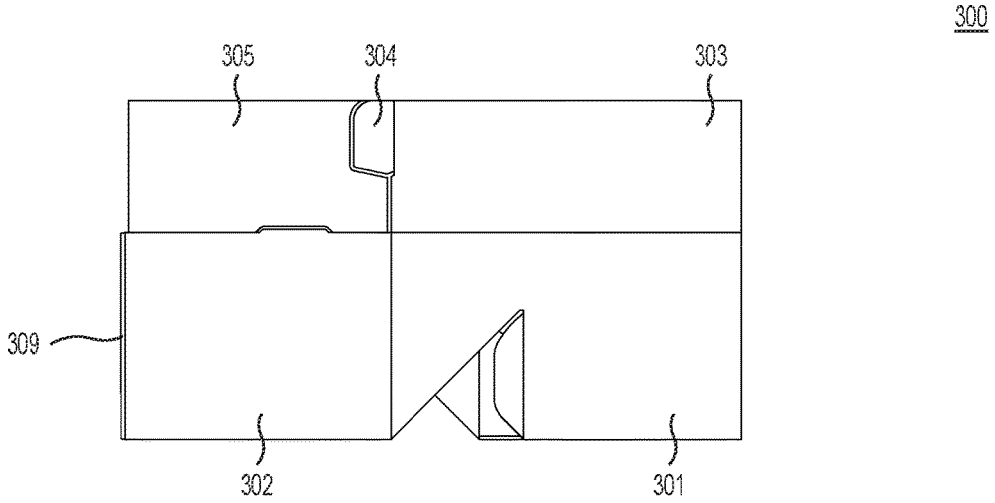
FIG. 3B is a diagram illustrating a plan view of a flat configuration of the container made from the blank shown in FIG. 3A.

FIG. 3B is a diagram illustrating a plan view of a flat configuration of the container made from the blank 300 shown in FIG. 3A.

Figure 3C:
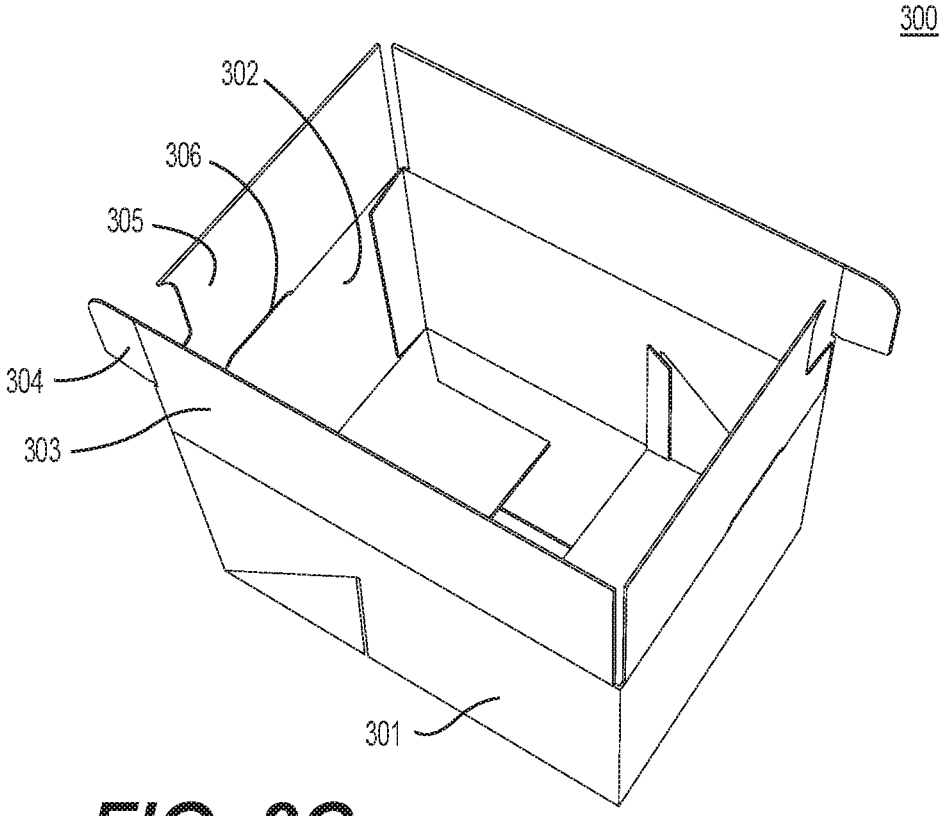
FIG. 3C is a diagram illustrating a perspective view of a box configuration of the container made from the blank shown in FIG. 3A.

FIG. 3C is a diagram illustrating a perspective view of a box configuration of the container made from the blank 300 shown in FIG. 3A.

Figure 4A:
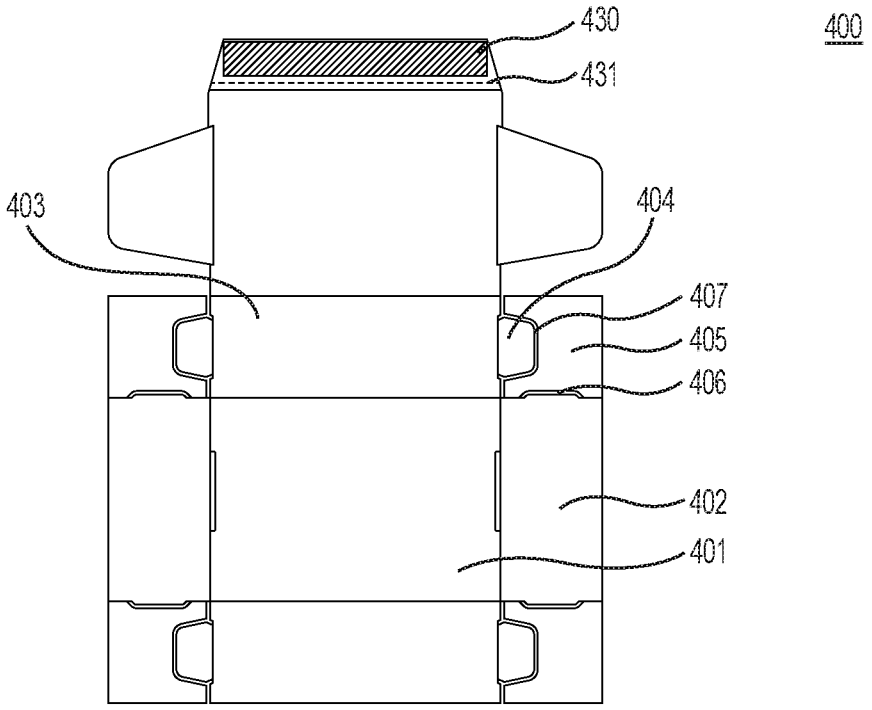
FIG. 4A is a diagram illustrating a plan view of an embodiment of a blank used for making a container. The blank comprises a primary panel, a secondary panel, and an opening. The secondary panel is hingedly coupled to the primary panel. The secondary panel is hingedly coupled to a secondary flap. The primary panel is hingedly coupled to a primary flap. The primary flap is hingedly coupled to a tab.

FIG. 4A is a diagram illustrating a plan view of an embodiment of a blank 400 used for making a container. The blank 400 comprises a primary panel 401, a secondary panel 402, and an opening 406. The secondary panel 402 is hingedly coupled to the primary panel 401. The secondary panel 402 is hingedly coupled to a secondary flap 405. The primary panel 401 is hingedly coupled to a primary flap 403. The primary flap is hingedly coupled to a tab 404. The blank 400 also comprises seal tape 430 and a tear line 431.

Figure 4B:
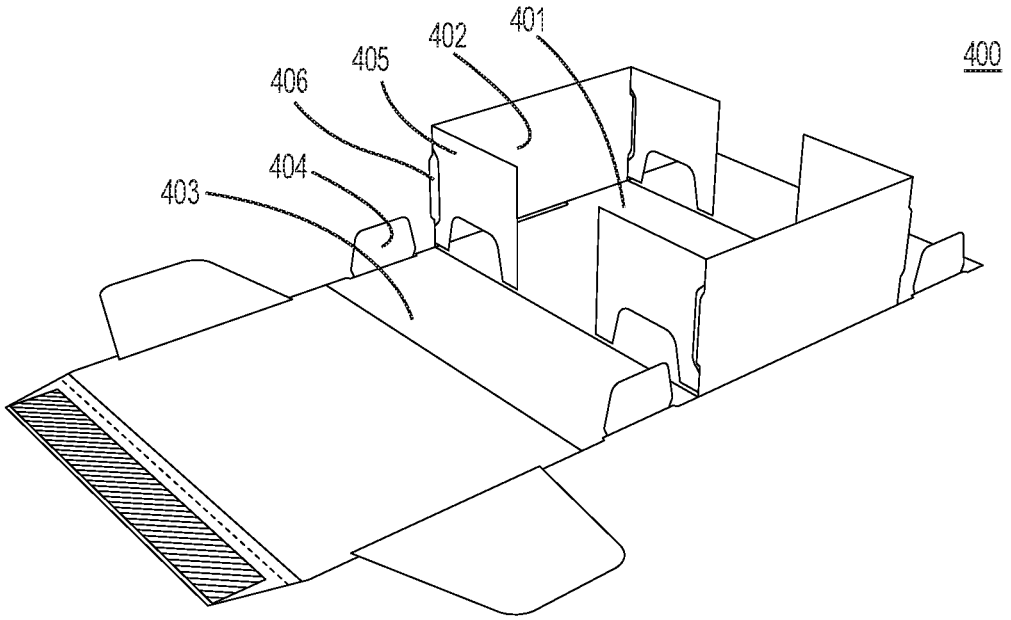
FIG. 4B is a diagram illustrating a perspective view of the blank shown in FIG. 4A, wherein the blank is folded.

FIG. 4B is a diagram illustrating a perspective view of the blank 400 shown in FIG. 4A, wherein the blank 400 is folded.

Figure 4C:
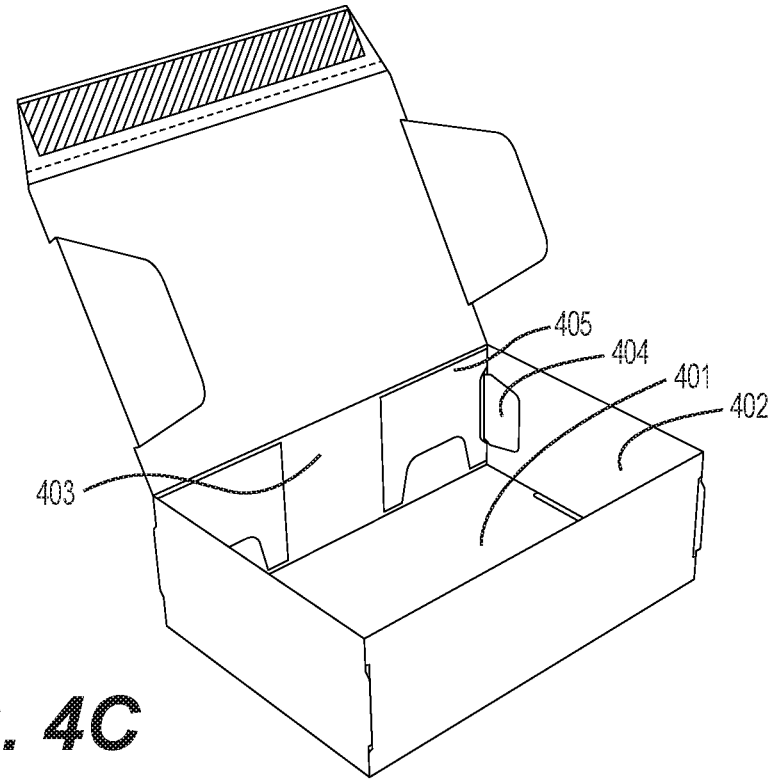
FIG. 4C is a diagram illustrating a perspective view of a box configuration of the container made from the blank shown in FIG. 4A.

FIG. 4C is a diagram illustrating a perspective view of a box configuration of the container made from the blank 400 shown in FIG. 4A.

Figure 4D:
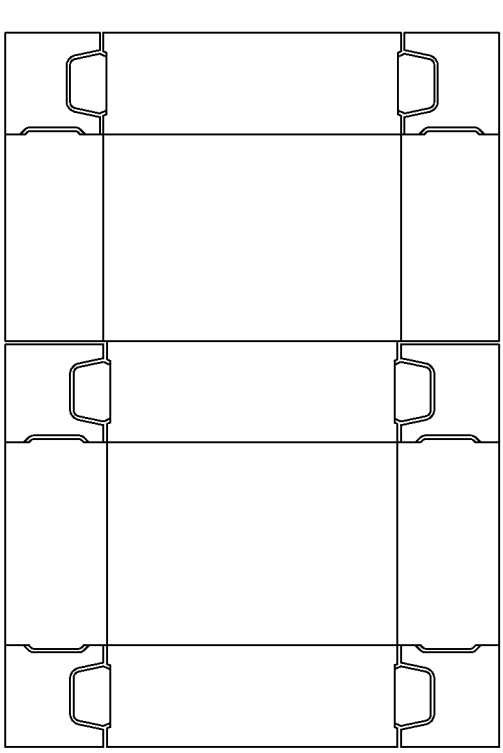
FIG. 4D is diagram illustrating a plan view of an embodiment of a blank used for making a container. The blank shown in FIG. 4D is an alternative configuration to the blank shown in FIG. 4A.
Figure 5A:
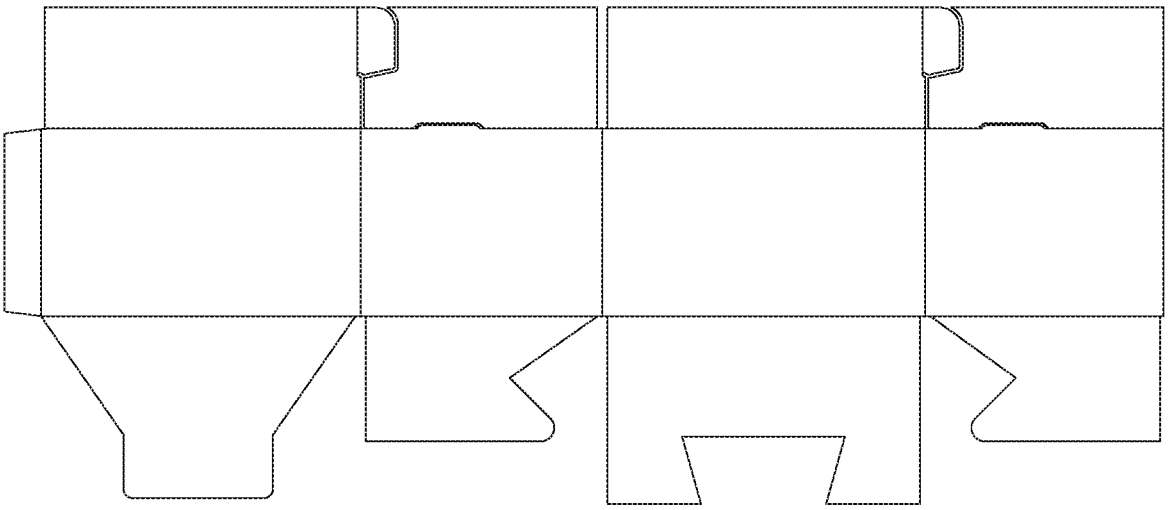
FIGS. 5A-5D are diagrams illustrating plan views of embodiments of blanks used for making containers. The blanks shown in FIGS. 5A-5D are alternative configurations to the blank shown in FIG. 1A.
Figure 5B:
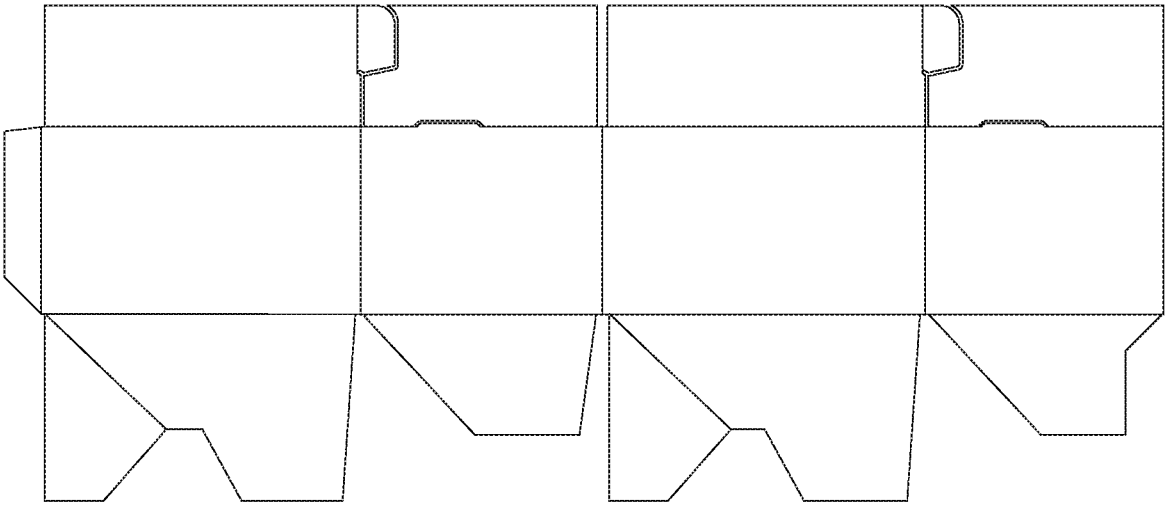
Figure 5C:
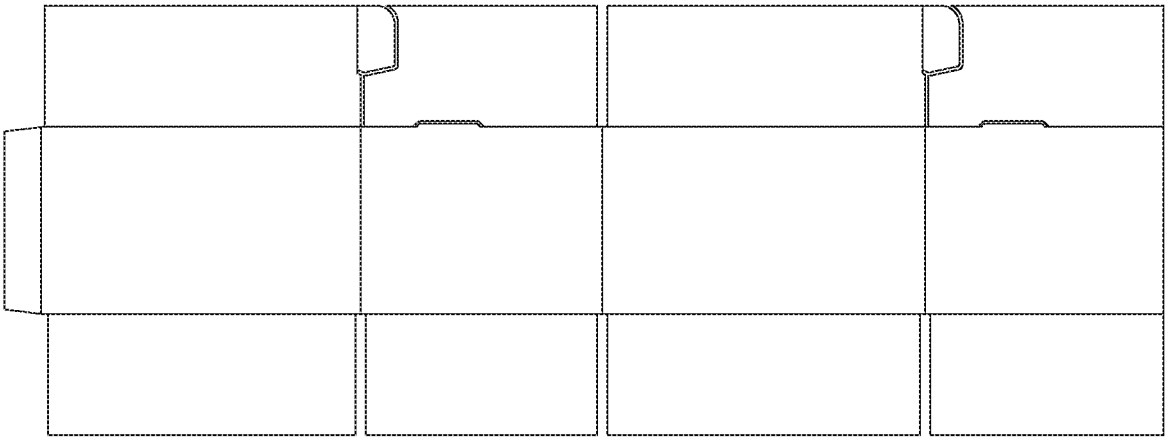
Figure 5D:
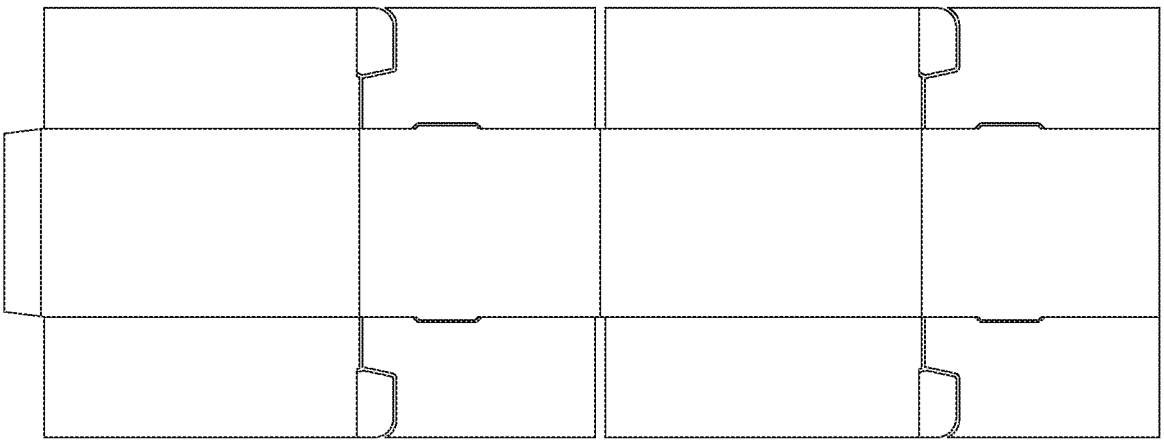
Figure 6A:
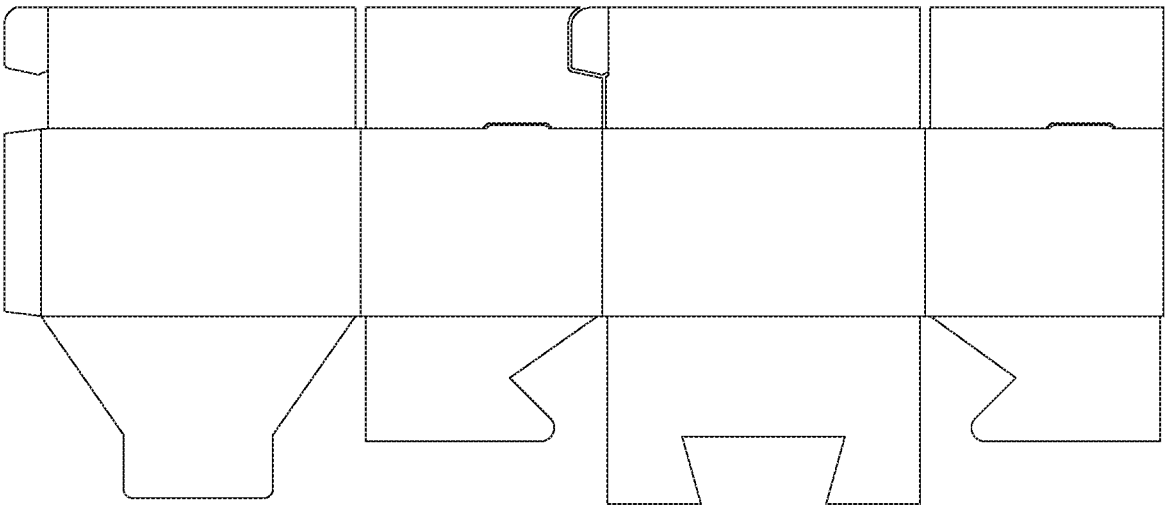
FIGS. 6A-6D are diagrams illustrating plan views of embodiments of blanks used for making containers. The blanks shown in FIGS. 6A-6D are alternative configurations to the blank shown in FIG. 2A.
Figure 6B:
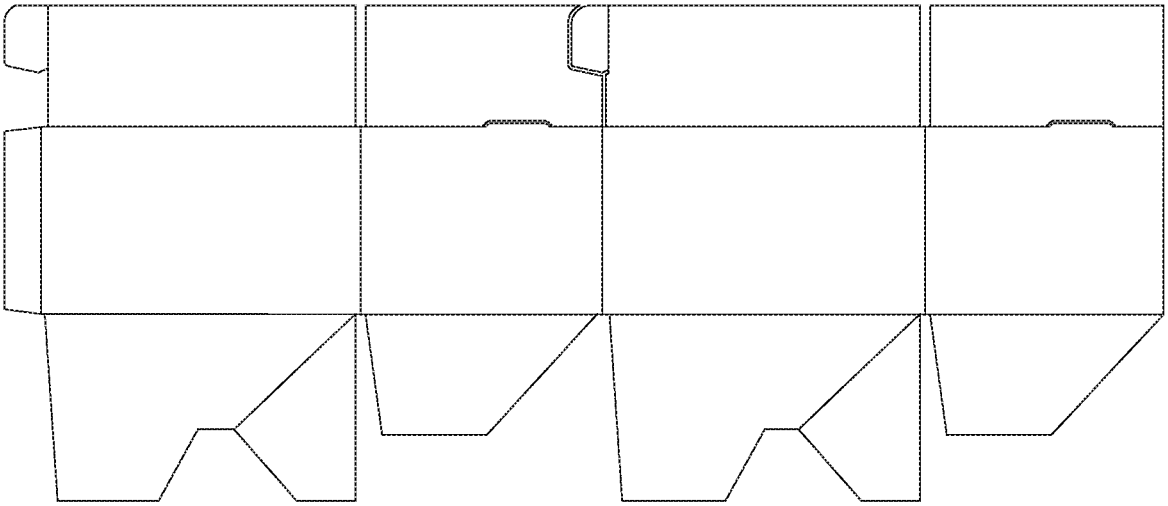
Figure 6C:
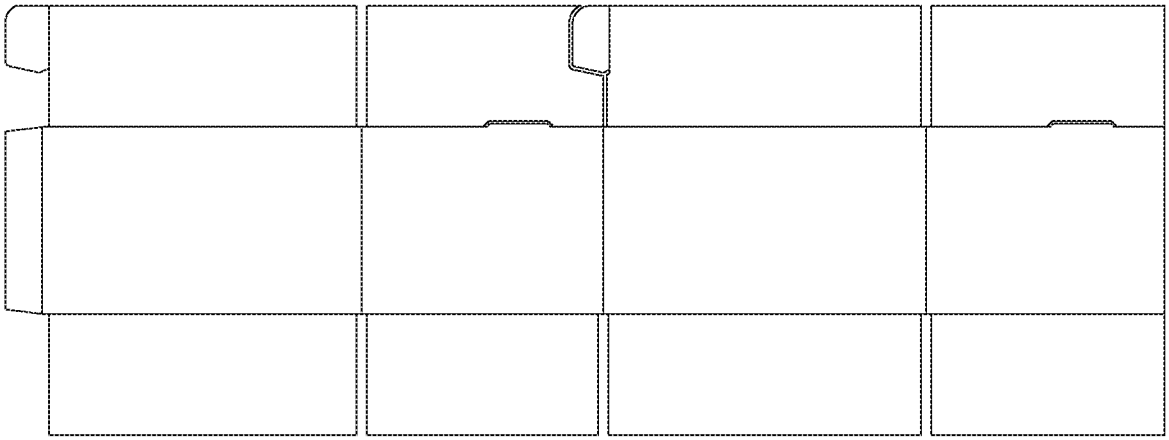
Figure 6D:
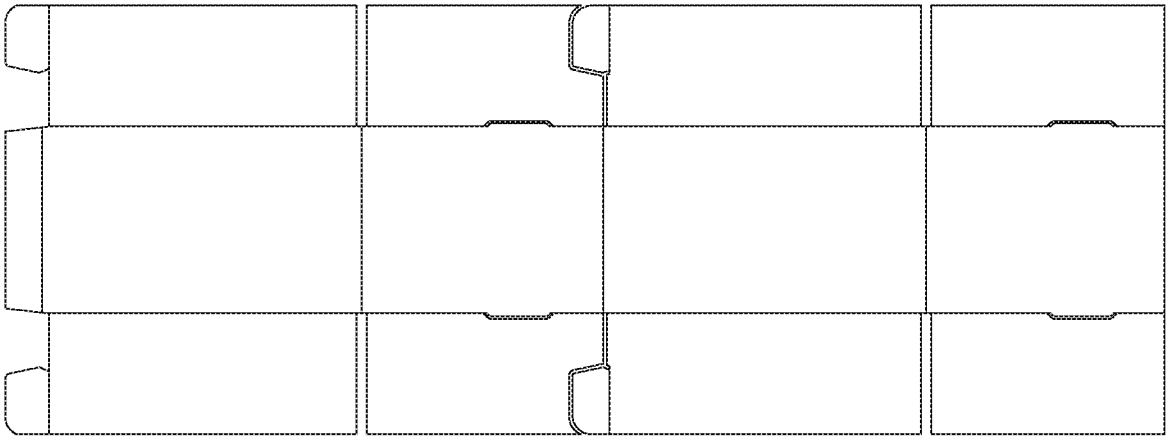

FIG. 4D is diagram illustrating a plan view of an embodiment of a blank 400*a* used for making a container. The blank 400*a* shown in FIG. 4D is an alternative configuration to the blank 400 shown in FIG. 4A.

FIGS. 5A-5D are diagrams illustrating plan views of embodiments of blanks 100*a*, 100*b*, 100*c*, 100*d* used for making containers. The blanks 100*a*, 100*b*, 100*c*, 100*d* shown in FIGS. 5A-5D are alternative configurations to the blank 100 shown in FIG. 1A.

FIGS. 6A-6D are diagrams illustrating plan views of embodiments of blanks 200*a*, 200*b*, 200*c*, 200*d* used for making containers. The blanks 200*a*, 200*b*, 200*c*, 200*d* shown in FIGS. 6A-6D are alternative configurations to the blank 200 shown in FIG. 2A.

With reference to FIGS. 1A-2H and 4A-4C, embodiments are directed to a blank 100, 200, 400 used for making a container. The blank 100, 200, 400 comprises a primary panel 101, 201, 401, a secondary panel 102, 202, 402, and an opening 106, 206, 406. The secondary panel 102, 202, 402 is hingedly coupled to the primary panel 101, 201, 401. The secondary panel 102, 202, 402 is hingedly coupled to a secondary flap 105, 205, 405. The primary panel 101, 201, 401 is hingedly coupled to a primary flap 103, 203, 403. The primary flap 103, 203, 403 is hingedly coupled to a tab 104, 204, 404. The tab 104, 204, 404 extends towards the secondary flap 105, 205, 405. At least a portion of the tab 104, 204, 404 lies within an aperture 107, 207, 407 positioned between the primary flap 103, 203, 403 and the secondary flap 105, 205, 405 (e.g., FIGS. 1A, 2A and 4A).

The secondary panel 102, 202, 402 is configured to fold towards the primary panel 101, 201, 401 (e.g., FIGS. 1E, 2E, and 4B). The secondary flap 105, 205, 405 is configured to fold towards the secondary panel 102, 202, 402 (e.g., FIGS. 1F, 2F, and 4B). The primary flap 103, 203, 403 is configured to fold towards the primary panel 101, 201, 401 (e.g., FIGS. 1G, 2G, and 4C). The tab 104, 204, 404 is configured to be inserted in the opening 106, 206, 406 when the container is in a box configuration (e.g., FIGS. 1H, 2H, and 4C).

In an embodiment, the secondary panel 102, 202, 402 is hingedly coupled to the secondary flap 105, 205, 405 via a hinge. The opening 106, 206, 406 is adjacent to or at the hinge (e.g., FIGS. 1A, 2A, and 4A). The hinge is shown schematically by the horizontal line between secondary panel 102, 202, 402 and secondary flap 105, 205, 405 in, for example, FIGS. 1A, 2A, and 4A.

In an embodiment, the secondary flap 105, 205, 405 comprises the opening 106, 206, 406 (e.g., FIGS. 1A, 2A, and 4A). Alternatively, the secondary panel 102, 202, 402 may comprise the opening 106, 206, 406.

In an embodiment, the opening 106, 206, 406 is a slit (e.g., FIGS. 1A, 2A and 4A).

In an embodiment, the at least a portion of the tab 104, 204, 404 and at least a portion of the aperture 107, 207, 407 have substantially the same shape (e.g., FIGS. 1A, 2A, and 4A).

In an embodiment, the tab 104, 204, 404 is configured to remain inserted in the opening 106, 206, 406 via an interlocking mechanism (e.g., FIGS. 1H, 2H, and 4C). The interlocking mechanism may be provided by the opening and/or the tab. The interlocking mechanism may maintain, at least partially, closure of the container. Such closure of the container may be temporary or permanent depending on the desired features. The interlocking mechanism may comprise friction-fit, a mechanical lock, a dimension of the tab larger than a dimension of the opening, and a combination thereof. In addition to the interlocking mechanism, tape may still be applied on the primary flap 103, 203 for example. The tape may be applied manually by the user or automatically using a taping device.

In an embodiment, the tab 104, 204, 404 is removably connected to the secondary flap 105, 205, 405. The tab 104, 204, 404 is configured to disconnect from the secondary flap 105, 205, 405 (e.g., FIGS. 1D, 2D, and 4B).

In an embodiment, the primary panel 101, 201 is a first primary panel 101, 201. The blank 100, 200 further comprises a second primary panel 111, 211. The first primary panel 101, 201 and the second primary panel 111, 211 are configured to simultaneously move away and move laterally, with respect to each other, when the container is moved from a flat configuration to the box configuration (e.g., FIGS. 1D and 2D).

In an embodiment, the blank 100, 200 further comprises a second primary panel 111, 211, a second secondary panel 112, 212, and a second opening 116, 216. The second primary panel 111, 211 is hingedly coupled to a second primary flap 113, 213. The second secondary panel 112, 212 is hingedly coupled to a second secondary flap 115, 215. The second primary flap 113, 213 is hingedly coupled to a second tab 114, 214 (e.g., FIGS. 1A and 2A). The second secondary panel 112, 212 is configured to fold towards the second primary panel 111, 211 (e.g., FIGS. 1E and 2E). The second secondary flap 115, 215 is configured to fold towards the second secondary panel 112, 212 (e.g., FIGS. 1F and 2F). The second primary flap 113, 213 is configured to fold towards the second primary panel 111, 211 (e.g., FIGS. 1G and 2G). The second tab 114, 214 is configured to be inserted in the second opening 116, 216 when the container is in the box configuration (e.g., FIGS. 1H and 2H).

With reference to FIGS. 1C-1H, 2C-2H, and 4A-4C, embodiments are directed to a container. It is noted that FIG. 4A may be considered both a blank and a flat configuration of a container since it may be constructed by the user. Similarly, it is noted that FIG. 4B may be considered both a folded blank and a container (where the container is moved from a flat configuration to a box configuration). The container comprises a primary panel 101, 201, 401, a secondary panel 102, 202, 402, and an opening 106, 206, 406. The secondary panel 102, 202, 402 is hingedly coupled to the primary panel 101, 201, 401. The secondary panel 102, 202, 402 is hingedly coupled to a secondary flap 105, 205, 405. The primary panel 101, 201, 401 is hingedly coupled to a primary flap 103, 203, 403. The primary flap 103, 203, 403 is hingedly coupled to a tab 104, 204, 404. The tab 104, 204, 404 extends towards the secondary flap 105, 205, 405 when the container is in a flat configuration. At least a portion of the tab 104, 204, 404 lies within an aperture 107, 207, 407 positioned between the primary flap 103, 203, 403 and the secondary flap 105, 205, 405 when the container is in the flat configuration (e.g., FIGS. 1C, 2C and 4A). The secondary panel 102, 202, 402 is configured to fold towards the primary panel 101, 201, 401 (e.g., FIGS. 1E, 2E, and 4B). The secondary flap 105, 205, 405 is configured to fold towards the secondary panel 102, 202, 402 (e.g., FIGS. 1F, 2F and 4B). The primary flap 103, 203, 403 is configured to fold towards the primary panel 101, 201, 401 (e.g., FIGS. 1G, 2G, and 4C). The tab 104, 204, 404 is configured to be inserted in the opening 106, 206, 406 when the container is in a box configuration (e.g., FIGS. 1H, 2H, and 4C).

Although embodiments are described above with reference to a blank used for making a container, wherein the primary panel is shown having a larger width than the secondary panel, the primary panel described in any of the above embodiments may alternatively have a smaller width than the secondary panel. For example, the primary flap, which is hingedly coupled to the tab, may have a smaller width than the secondary flap. Such alternatives are considered to be within the spirit and scope of the present invention, and may therefore utilize the advantages of the configurations and embodiments described above.

In addition, although embodiments are described above with reference to a blank used for making a container, wherein the primary panel is shown as a side of the container, the primary panel described in any of the above embodiments may alternatively be a bottom of the container or a top of the container. Such alternatives are considered to be within the spirit and scope of the present invention, and may therefore utilize the advantages of the configurations and embodiments described above.

Further, although embodiments are described above with reference to a blank used for making a container, wherein the primary panel and the secondary panel are shown perpendicular with each other when the container is in the box configuration, the primary panel and the secondary panel described in any of the above embodiments may alternatively be at an acute angle with each other or at an obtuse angle with each other when the container is in the box configuration. The opening and the tab may accommodate such alternatives. Such alternatives are considered to be within the spirit and scope of the present invention, and may therefore utilize the advantages of the configurations and embodiments described above.

Yet further, although embodiments are described above with reference to a blank used for making a container, wherein the blank is shown with uniform portions (e.g., with uniform thickness), portions or all of the blank described in any of the above embodiments may alternatively be non-uniform (e.g., having varying thickness, discontinuities such as holes, slits, grooves, ridges, slits, a combination thereof, etc.). Such alternatives are considered to be within the spirit and scope of the present invention, and may therefore utilize the advantages of the configurations and embodiments described above.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. A blank used for making a container, the blank comprising:

a primary panel;

a secondary panel;

an opening;

wherein the secondary panel is hingedly coupled to the primary panel, and wherein the secondary panel is hingedly coupled to a secondary flap;

wherein the primary panel is hingedly coupled to a primary flap, and wherein the primary flap is hingedly coupled to a tab;

wherein the tab extends towards the secondary flap, and wherein at least a portion of the tab lies within an aperture positioned between the primary flap and the secondary flap; and wherein the secondary panel is configured to fold towards the primary panel, wherein the secondary flap is configured to fold towards the secondary panel, wherein the primary flap is configured to fold towards the primary panel, and wherein the tab is configured to be inserted in the opening when the container is in a box configuration.

2. The blank of claim 1, wherein the secondary panel is hingedly coupled to the secondary flap via a hinge, and wherein the opening is adjacent to or at the hinge.

3. The blank of claim 1, wherein the secondary flap comprises the opening.

4. The blank of claim 1, wherein the opening is a slit.

5. The blank of claim 1, wherein the at least a portion of the tab and at least a portion of the aperture have substantially the same shape.

6. The blank of claim 1, wherein the tab is configured to remain inserted in the opening via an interlocking mechanism.

7. The blank of claim 1, wherein the tab is removably connected to the secondary flap, and wherein the tab is configured to disconnect from the secondary flap.

8. The blank of claim 1, wherein the primary panel is a first primary panel, wherein the blank further comprises a second primary panel, and wherein the first primary panel and the second primary panel are configured to simultaneously move away and move laterally, with respect to each other, when the container is moved from a flat configuration to the box configuration.

9. A container made from a single blank, the container comprising:

a primary panel;

a secondary panel;

an opening;

wherein the secondary panel is hingedly coupled to the primary panel, and wherein the secondary panel is hingedly coupled to a secondary flap;

wherein the primary panel is hingedly coupled to a primary flap, and wherein the primary flap is hingedly coupled to a tab;

wherein the tab extends towards the secondary flap when the container is in a flat configuration, and wherein at least a portion of the tab lies within an aperture positioned between the primary flap and the secondary flap when the container is in the flat configuration; and wherein the secondary panel is configured to fold towards the primary panel, wherein the secondary flap is configured to fold towards the secondary panel, wherein the primary flap is configured to fold towards the primary panel, and wherein the tab is configured to be inserted in the opening when the container is in a box configuration.

* * * * *